United States Patent [19]

Smart

[11] Patent Number: 5,014,894

[45] Date of Patent: May 14, 1991

[54] AUTOMATIC RIVETING MACHINE

[75] Inventor: Charles F. Smart, Danbury, Conn.

[73] Assignee: Emhart Industries, Inc., Towson, Md.

[21] Appl. No.: 444,927

[22] Filed: Dec. 1, 1989

[51] Int. Cl.[5] ..... B21J 15/10

[52] U.S. Cl. ..... 227/6; 227/112; 227/117

[58] Field of Search ..... 227/6, 7, 116, 118, 227/53, 117, 112; 72/11

[56] References Cited

U.S. PATENT DOCUMENTS 4,747,294 5/1988 Schwartz et al. ..... 72/391

4,754,643 7/1988 Weeks, Jr. et al. ..... 72/391

*Primary Examiner*—Frank T. Yost

*Assistant Examiner*—John M. Husar

*Attorney, Agent, or Firm*—Spencer T. Smith

[57] ABSTRACT

An automatic riveting machine determines that an operator has manually removed a rivet from the nose of the gun by sensing its insertion into the nose and its subsequent absence prior to gun operation.

3 Claims, 3 Drawing Sheets

AUTOMATIC RIVETING MACHINE

The present invention relates to automatic riveting machines such as disclosed in U.S. Pat. Nos. 4,747,294 and 4,754,643.

In such machines rivets are automatically fed one at a time, to a rivet gun by a loading device. Occasionally, the rivet is not to spec, being oval or square, and will be removed by an operator.

It is an object of the present invention to enable the operator to control the reloading of the gun.

Other objects and advantages of the present invention will become apparent from the following portion of this specification and from the accompanying drawings which illustrate in accordance with the mandate of the patent statutes, a presently preferred embodiment incorporating the principles of the invention.

Referring to the drawings.

Figure 1:
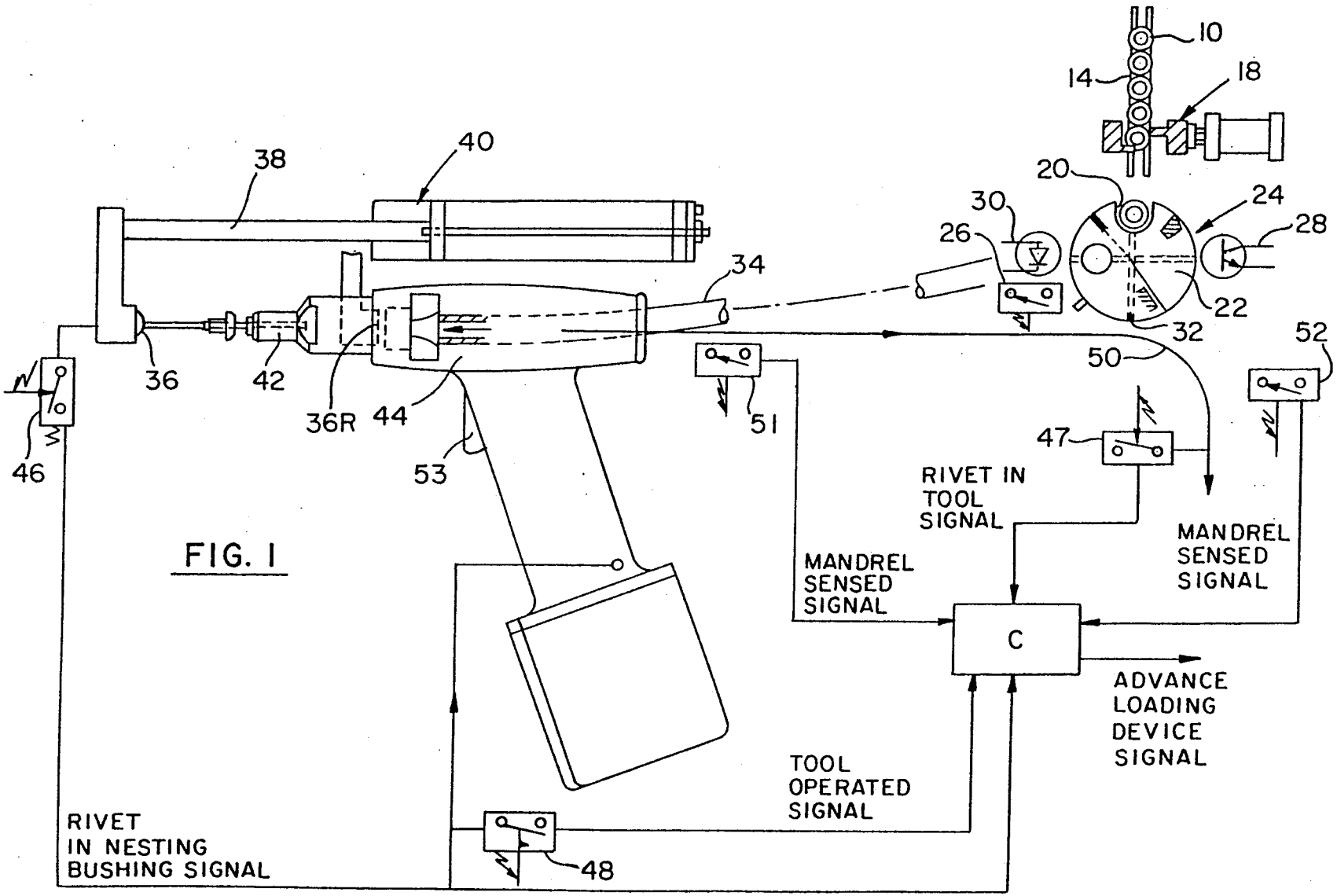
FIG. 1 is a schematic representation of a portion of an automatic riveting machine made in accordance with the teachings of the present invention.

Rivets 10 are released, one at a time, from a feed track 14 by a gating mechanism 18 and will be received within an axial channel 20 defined in the cylindrical rotor 22 of an escapement mechanism 24. The rotor indexes 90 degrees from its receiving orientation to its transfer orientation (sensed by a proximity switch 26) and the presence of a rivet in the axial channel 20 at the transfer location is confirmed by a light sensor 28 which will go dark as a result of the rivet blocking light transmission from a light source 30 through a diametral bore 32 in the rotor. Air under pressure (not shown) is then connected to blow the rivet through the rivet feed tube 34 to the retracted nesting bushing 36R (shown in phantom) of the extendable pivot arm 38 of the presenting device 40. The nesting bushing 36 is under a vacuum which pulls the rivet into the bushing. The arm 38 is then extended and pivoted to the illustrated feed position whereupon the vacuum is removed and pressure is applied to blow the rivet into the aperature 100 of the nose 42 of the rivet gun 44. As soon as a rivet is transferred from the nesting bushing 36 to the nose 42 of the gun, the loading arm 38 pivots away and is retracted to the rivet load position where another rivet will be transferred to the nesting bushing.

A vacuum switch 46 senses the presence of the rivet in the nesting bushing and generates a Rivet In Nesting Bushing Signal and a vacuum switch 47 which senses the pressure in the mandrel collection tube 50 and hence senses the presence of a rivet in the nose 42, generates a Rivet In Tool Signal. An air flow switch 48 senses gun operation and generates a Tool Operated Signal which indicates that a rivet has been set.

Figure 2:
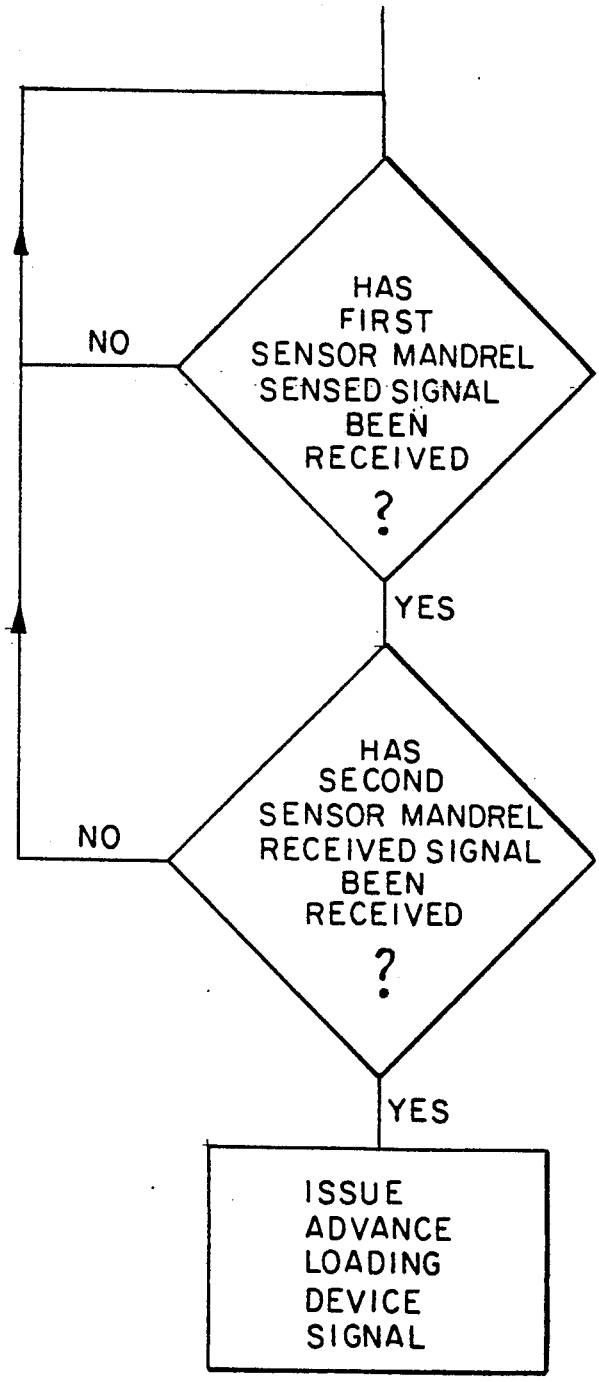
FIG. 2 is part of a flow chart illustrating the control of rivet feed to the rivet gun of the automatic riveting machine illustrated in FIG. 1.

If the spent mandrel is properly withdrawn from the tool through the mandrel collection tube 50, sensors 51,52 at either end of the collection tube will sense the passing mandrel and will issue Mandrel Sensed Signals. The controller will then issue an advance loading device signal to operate the loading device 40 to transfer the next rivet to the tool (FIG. 2).

In operation when the rivet is transferred from the nesting bushing 36 to the nose 42 of the tool 44 the Rivet In Nesting Bushing Signal will be removed and the Rivet In Tool Signal will be issued. When a rivet is bad the operator instead of operating the tool by pulling the trigger 53 will remove the bad rivet from the nose resulting in the removal of the Rivet In Tool Signal without a Tool Operated Signal being issued.

Figure 3:
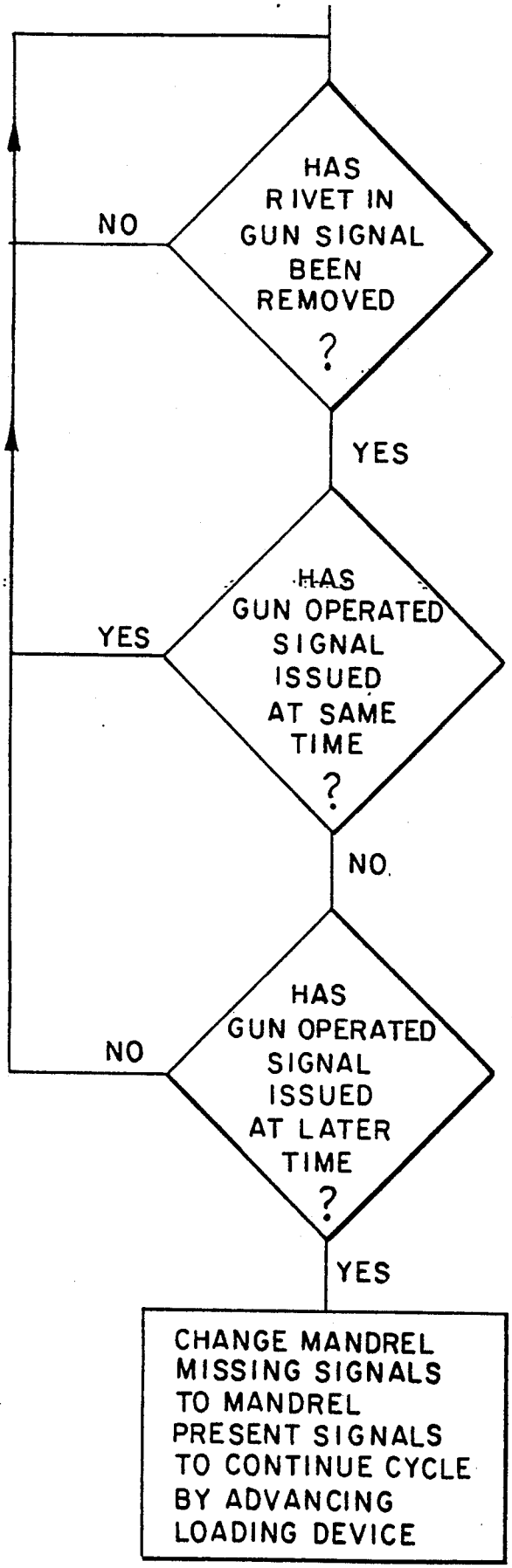
FIG. 3 is another part of a flow chart.

As shown in FIG. 3, the controller determines that a bad rivet has been removed by the operator since the Rivet In Tool Signal has disappeared without the tool being operated. Even though there is no rivet in the nose the operator will pull the trigger 53. Mandrel Sensed Signals will not issue from the collection tube sensors 51,52 since a spent mandrel has not passed through the collection tube (there was no rivet to set). The controller C however, knowing that the rivet has been manually removed will provide the required Mandrel Sensed Signals and the cycle will then continue, as it would had a rivet been set, with the controller issuing an Advance Loading Device Signal to advance the loading device to deliver the next rivet to the nose portion of the tool.

I claim:

1. An automatic riveting machine comprising a rivet tool including a rivet receiving nose portion and a trigger for operating the tool, rivet loading means including a nesting bushing, means for displacing said nesting bushing between a rivet receiving position and a rivet transferring position, and means for transferring a rivet from said nesting bushing at said transferring position to said receiving nose portion, means for operating said displacing means to displace said nesting bushing from said transferring position to said receiving position after a rivet has been transferred to said receiving nose portion, feeding means for feeding a rivet to said nesting bushing at said receiving position, means for enabling the operating of said displacing means to displace said nesting bushing with a rivet received therein from said receiving position to said transferring position following the setting of a rivet, and means for enabling the operation of said displacing means to displace said nesting bushing with a rivet received therein from said receiving position to said transferring position following the manual removal of a rivet in said receiving nose portion including means for sensing the presence or absence of a rivet in said receiving nose portion and means for determining that a rivet received by said receiving nose portion has been removed without tool operation.

2. An automatic riveting machine according to claim 1, wherein said determining means includes means for signaling the operation of said rivet tool to set a rivet.

3. An automatic riveting machine according to claim 2 wherein said determining means further comprises means for determining that the rivet was removed from said receiving nose portion prior to the issuance of a signal by said signalling means.

* * * * *